US011939656B2

(12) United States Patent
Cadotte et al.

(10) Patent No.: US 11,939,656 B2
(45) Date of Patent: Mar. 26, 2024

(54) SNOUT FOR USE IN A HOT DIP COATING LINE

(71) Applicant: Cleveland-Cliffs Steel Properties Inc., West Chester, OH (US)

(72) Inventors: Daniel J. Cadotte, Middletown, OH (US); Russell Dejarnatt, Liberty Township, OH (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 132 days.

(21) Appl. No.: 17/325,403

(22) Filed: May 20, 2021

(65) Prior Publication Data

US 2021/0363624 A1 Nov. 25, 2021

Related U.S. Application Data

(60) Provisional application No. 63/028,764, filed on May 22, 2020.

(51) Int. Cl.
*C23C 2/00* (2006.01)
*C23C 2/40* (2006.01)

(52) U.S. Cl.
CPC ..... *C23C 2/003* (2013.01); *C23C 2/004* (2022.08); *C23C 2/40* (2013.01)

(58) Field of Classification Search
None
See application file for complete search history.

(56) References Cited

U.S. PATENT DOCUMENTS

| | | | | |
|---|---|---|---|---|
| 3,183,718 | A | 5/1965 | Schnedler | |
| 5,538,559 | A | 7/1996 | Kleimeyer et al. | |
| 5,718,766 | A * | 2/1998 | Vignot | C23C 2/003 118/423 |
| 6,051,183 | A | 4/2000 | Morando | |
| 6,284,062 | B1 | 9/2001 | Nagashima et al. | |
| 6,428,851 | B1 | 8/2002 | Friedersdorf et al. | |
| 6,770,140 | B2 | 8/2004 | Ishii et al. | |
| 8,047,718 | B2 | 11/2011 | Kim et al. | |
| 9,133,540 | B2 | 9/2015 | Jang et al. | |
| 10,480,500 | B2 | 11/2019 | Lee et al. | |
| 2004/0028832 | A1 | 2/2004 | Dauchelle | |
| 2006/0180079 | A1 * | 8/2006 | Sapp | C23C 2/003 118/413 |
| 2008/0274006 | A1 | 11/2008 | Bright et al. | |

(Continued)

FOREIGN PATENT DOCUMENTS

| | | | |
|---|---|---|---|
| CN | 201172680 | Y | 12/2008 |
| GB | 353410 | A | 7/1931 |

(Continued)

OTHER PUBLICATIONS

International Search Report and Written Opinion for Application No. PCT/US2021/033289, 13 pages.

*Primary Examiner* — Binu Thomas
(74) *Attorney, Agent, or Firm* — Frost Brown Todd LLP

(57) ABSTRACT

A continuous coating line includes a snout assembly exposed to molten metal. The snout assembly includes a snout tip positioned about a steel strip that is immersible in the molten metal to provide a seal around the steel strip during entry into the molten metal. The snout tip includes a refractory material that is resistant to wear, abrasion, and corrosion when the snout tip is exposed to the molten metal.

15 Claims, 7 Drawing Sheets

(56) References Cited

U.S. PATENT DOCUMENTS

| | | | | |
|---|---|---|---|---|
| 2015/0368776 | A1 | 12/2015 | Bergen | |
| 2016/0102393 | A1* | 4/2016 | Schaffrath | C23C 2/003 118/712 |
| 2018/0245192 | A1 | 8/2018 | Kweon et al. | |
| 2019/0062888 | A1* | 2/2019 | Saint-Raymond | C23C 2/003 |
| 2019/0144982 | A1 | 5/2019 | Veg | |
| 2019/0161842 | A1* | 5/2019 | Niedringhaus | C23C 2/003 |
| 2019/0376171 | A1 | 12/2019 | Cadotte et al. | |
| 2020/0399749 | A1 | 12/2020 | Garcia Martino | |
| 2021/0180171 | A1* | 6/2021 | Garcia Martino | C23C 2/003 |

FOREIGN PATENT DOCUMENTS

| | | | |
|---|---|---|---|
| IN | 201817005829 | A | 6/2018 |
| JP | H04-99852 | A | 3/1992 |
| JP | H05-271887 | A | 10/1993 |
| KR | 2018-0023500 | A | 3/2018 |
| WO | WO 2021/084299 | A1 | 5/2021 |

* cited by examiner

SNOUT FOR USE IN A HOT DIP COATING LINE

The present application claims priority to U.S. Provisional Patent Application Ser. No. 63/028,764, entitled "Use of Technical Ceramics To Improve The Life Of Coating Line Snouts," filed on May 22, 2020, the disclosure of which is incorporated by reference herein.

BACKGROUND

Coating is a common process used in steel making to provide a thin metal coating (e.g., aluminum, zinc, etc.) on the surface of a steel substrate, such as an elongated steel sheet or strip. It should be understood that an elongated steel sheet or strip are used and understood herein to be interchangeable. The coating process may be generally incorporated into a continuous coating line where an elongated steel sheet is threaded through a series of roll assemblies to subject the steel sheet to various treatment processes. During the coating portion of this process, the steel sheet is manipulated through a bath of molten metal to coat the surfaces of the steel sheet.

Referring to FIG. 1, an illustrative schematic of a coating portion (10) of a steel processing line (2), such as a continuous steel processing line, is shown. Coating portion (10) is generally configured to receive an elongated steel sheet (60) for coating steel sheet (60). Coating portion (10) includes a hot dip tank (20) that is defined by a solid wall configured to receive molten metal (22), such as aluminum, zinc, and/or alloys thereof. One or more roll assemblies (40, 50, 70) are positioned relative to hot dip tank (20) to support steel sheet (60) through coating portion (10). For instance, sink roll assemblies (40) can be used to position steel sheet (60) in hot dip tank (20). Steel sheet (60) may then be redirected in a desired direction by stab roll assembly (70), through air knives (35), to deflector roll assembly (50).

A snout (30) is positioned about steel sheet (60) at an entry of hot dip tank (20). A bottom portion of snout (30) comprises a snout tip (32) that is configured to be at least partially submerged within molten metal (22). Accordingly, snout (30) generally provides an air-tight seal around steel sheet (60) during entry into molten metal (22). In some instances, snout (30) is filled with a nonreactive or reducing gas such as hydrogen and/or nitrogen to limit chemical oxidation reactions that may occur during entry of steel sheet (60) into molten metal (22).

Accordingly, a snout is generally used in a coating line to protect a steel strip from atmosphere as it feeds into the molten metal. A snout tip is typically immersed in molten metal and is manufactured from ferrous materials (e.g., stainless steel, high carbon steel, etc). Degradation of the ferrous material of the snout tip can occur from immersion in the molten metal that can lead to holes and/or breaches in the snout tip. This can expose the steel strip positioned within the snout tip to external atmosphere, which can result in poor coating quality of the steel strip. Degradation of the snout tip can be attributed to dissolution of a portion of the snout tip immersed and in contact with the molten metal, and/or erosion of the snout tip by the relative movement of the molten metal at the air-metal interface as well as below the liquid metal surface. Such degradation can require the snout tip to be replaced. For instance, a snout tip in an aluminum coating line is typically replaced about every six months. An example of a prior art degraded snout tip is shown in FIG. 2 after about 8 months in service. When the snout tip is replaced, the continuous coating line is shut down. This procedure generally results in increased costs and undesirable manufacturing delays. However, these costs and delays may be reduced by increasing the service life of snout tips exposed to molten metal.

Accordingly, it may be desirable to include various features within a coating line to improve the overall service life of components subject to wear and/or deterioration. To overcome these challenges, at least a portion of a snout and/or snout tip is made from a refractory material to reduce the amount of wear, abrasion, and/or corrosion on the snout.

SUMMARY

Snout assemblies positioned within coating lines encounter at least some liquid metal abrasion and chemical attack when used within coating baths for coating processes. Under some circumstances, this abrasion and/or chemical attack may lead to reduced duty cycles for such snout assemblies. Thus, it is desirable to reduce abrasion and/or chemical attack encountered with snout assemblies used in coating processes.

Refractory materials, such as ceramic, provide superior resistance to abrasion and chemical attack encountered in environments surrounded by molten metal. Snout assemblies comprising such refractory materials can also be reused in a coating line. Thus, the present application relates to structures and/or methods for incorporating refractory materials into snout assemblies.

BRIEF DESCRIPTION OF THE FIGURES

The accompanying figures, which are incorporated in and constitute a part of this specification, illustrate embodiments, and together with the general description given above, and the detailed description of the embodiments given below, serve to explain the principles of the present disclosure.

DETAILED DESCRIPTION

The present application generally relates to structures and/or methods for incorporating a refractory material within a snout assembly of a continuous coating line. In such a configuration, it has been found that the presence of the refractory material may reduce wear on the snout assembly and may also reduce the propensity of the snout assembly to be subject to chemical attack from the molten metal. This can improve the life of the snout assembly and/or reduce repair costs in a coating line. The life of the snout assembly can thereby be increased, such as by at least 4 times, to avoid line stops and repair cost.

Embodiments of a snout assembly incorporating refractory materials are discussed in more detail below. Because such snout assemblies may reduce wear, corrosion, and/or abrasion of the snout assembly, it should be understood that any element of such a snout assembly may be incorporated into any one or more snout assemblies in a continuous coating line. These snout assemblies may include, but are not limited, to any portion of a snout (30) and/or a snout tip (32) as described above.

I. A Snout Assemblies Comprising a Refractory Material

Figure 1:
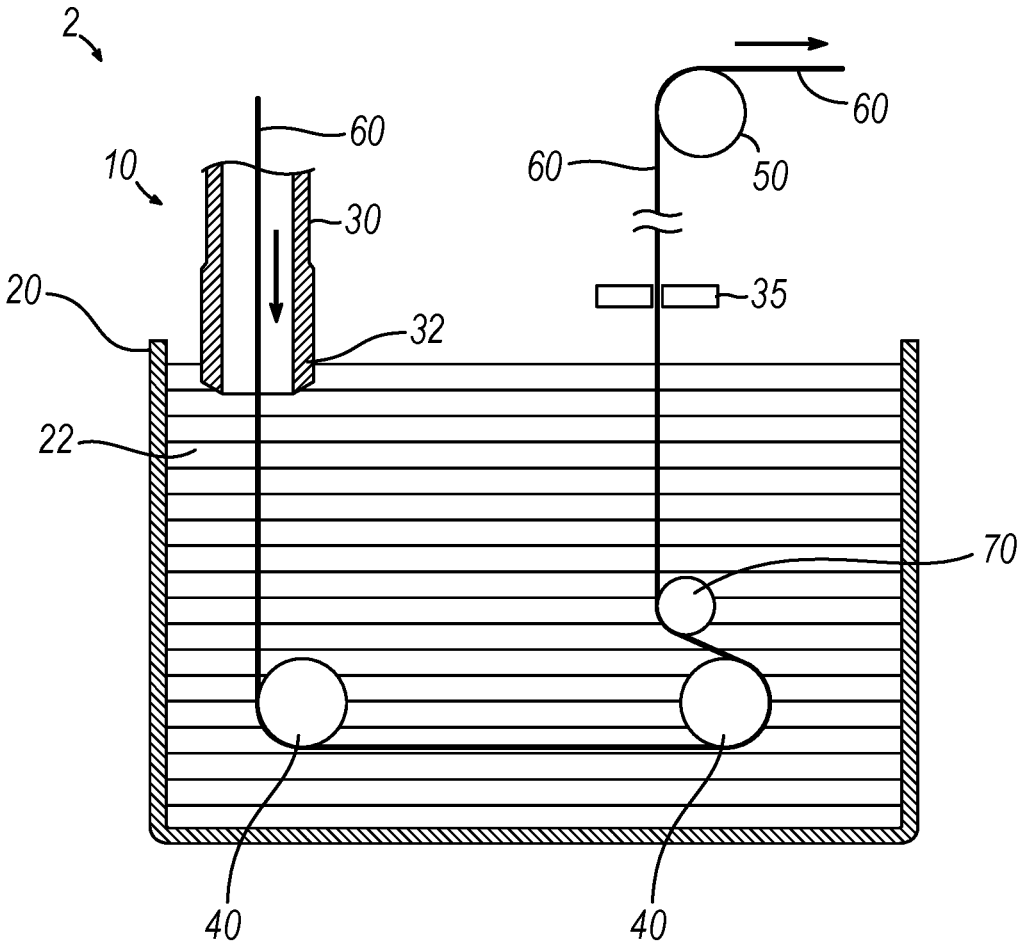
FIG. 1 depicts a schematic view of a configuration of a coating portion in a continuous steel processing line.
Figure 2:
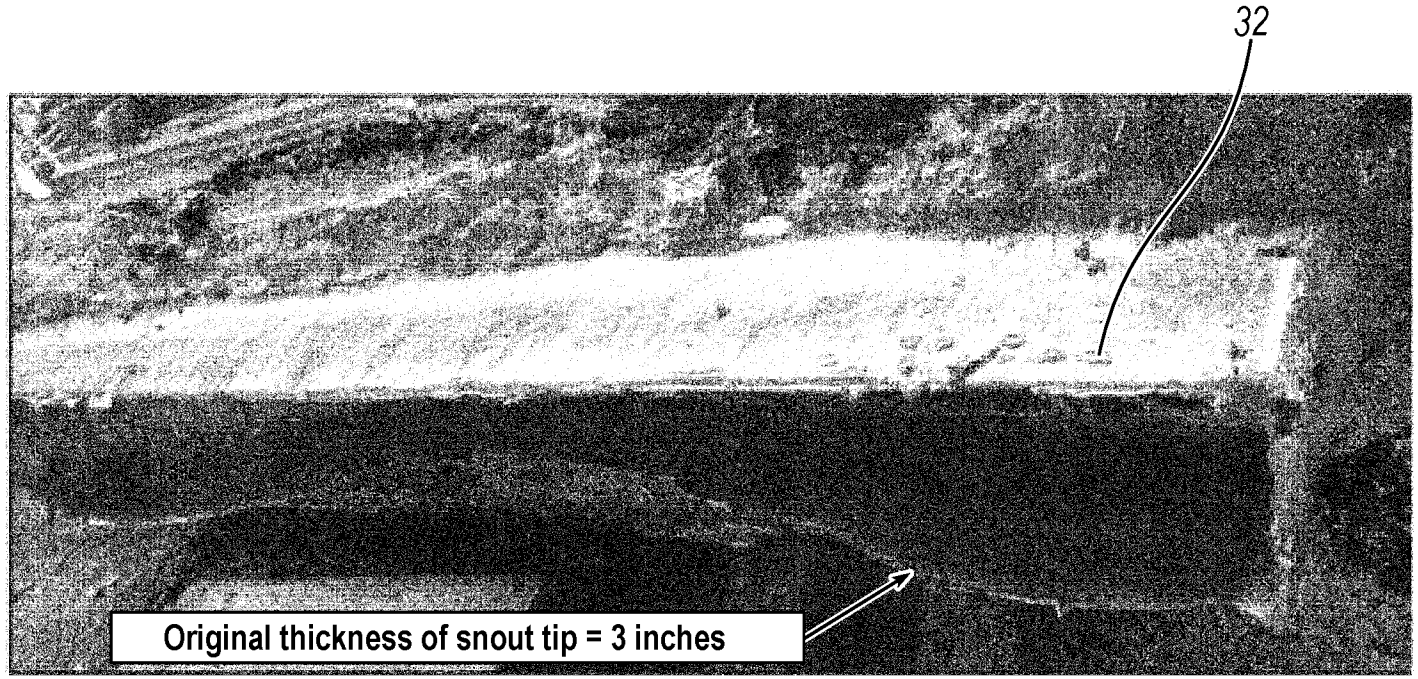
FIG. 2 PRIOR ART
FIG. 2 depicts a photo of a snout tip of a coating portion such as in the continuous steel processing line of FIG. 1 after insertion within a molten aluminum bath.
Figure 3:
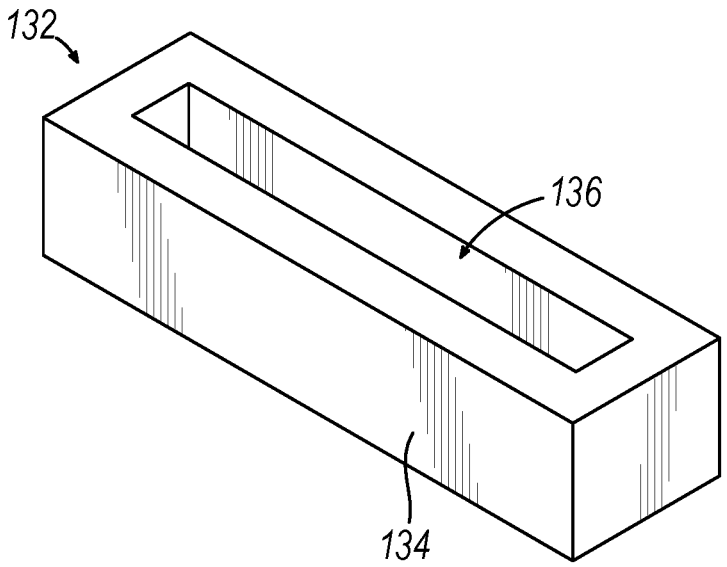
FIG. 3 depicts a perspective view of a first exemplary snout tip having a refractory material for use with a snout in a coating portion such as in the continuous steel processing line of FIG. 1.
Figure 4:
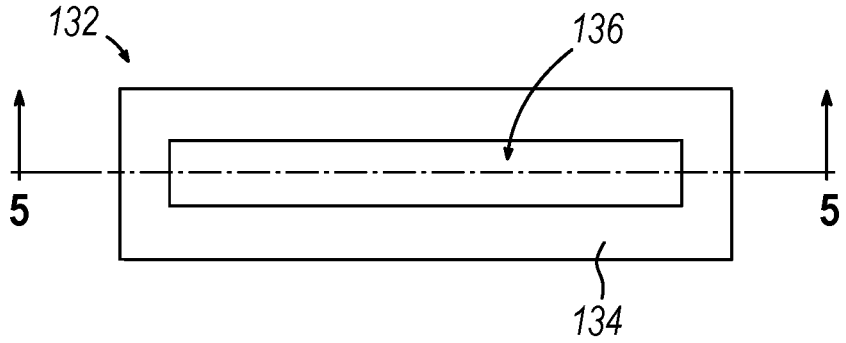
FIG. 4 depicts a top plan view of the snout tip of FIG. 3.
Figure 5:
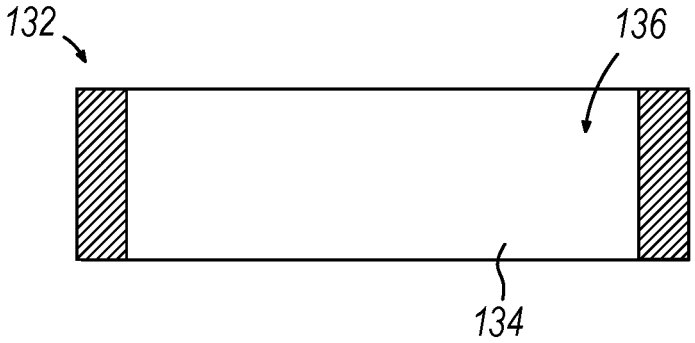
FIG. 5 depicts a cross-sectional view of the snout tip of FIG. 3 taken along line 5-5 of FIG. 4.

Referring to FIGS. 3-5, an exemplary snout tip (132) is shown comprising a body (134) that defines an opening (136) therethrough for receiving steel strip (60). While body (134) and opening (136) are shown as being rectangular in the illustrated version, body (134) and/or opening (136) can be any suitable shape (e.g., square, elliptical, round, etc.) that is configured to receive steel strip (60). For instance, snout tip (132) can be coupled, such as by welding, with a snout (30) of a coating portion (10) in a continuous steel processing line. At least a portion of snout tip (132) is configured to be immersed in molten metal (22) of hot dip tank (20) to thereby protect steel sheet (60) from atmosphere.

Snout tip (132) comprises a refractory material that has high strength and is resistant to wear at high temperature. This refractory material may additionally have a low coefficient of thermal expansion, resistance to thermal shock, resistance to wetting by molten metal, resistance to corrosion, and is substantially chemically inert to molten metals. Such refractory materials can include non-metallic ceramic materials (e.g., alumina, fireclays, bauxite, chromite, dolomite, magnesite, silicon carbide, fused silica, silicon dioxide, zirconia, etc.), refractory metals (e.g., niobium, chromium, molybdenum, tantalum, tungsten, rhenium, vanadium, hafnium, titanium, zirconium, ruthenium, osmium, rhodium, iridium, etc.) and/or combinations thereof. In some versions, the refractory ceramic material comprises between about 5% and about 100% silicon carbide and/or alumina.

By way of example only, suitable refractory ceramic materials may include a class of ceramics known as SiAlON ceramics. SiAlON ceramics are high-temperature refractory materials that may be used in handling molten aluminum. SiAlON ceramics generally exhibit good thermal shock resistance, high strength at high temperatures, exceptional resistance to wetting by molten aluminum, and high corrosion resistance in the presence of molten non-ferrous metals.

Other suitable refractory ceramic materials may include a ceramic having about 73% $Al_2O_3$ and about 8% SiC. This ceramic may comprise GemStone® 404A manufactured by Wahl Refractory Solutions of Fremont, Ohio. In another embodiment, a harder ceramic having a greater amount of SiC, such as about 70% SiC, may be used. In some versions, metal filaments, such as stainless steel wire needles, may be added to the ceramic material, such as about 0.5 percent to about 30 percent by weight of the material. Such a ceramic may comprise ADVANCER® and/or CRYSTON® CN178 nitride bonded silicon carbide manufactured by Saint-Gobain Ceramics of Worcester, Massachusetts, and/or Hexology® silicon carbide also manufactured by Saint-Gobain Ceramics of Worcester, Massachusetts. Another suitable refractory ceramic material may include a ceramic having about 59% $Al_2O_3$ and about 33% $SiO_2$. This ceramic may comprise Slurry Infiltrated Fiber Castable (SIFCA®) manufactured by Wahl Refractory Solutions of Fremont, Ohio. Accordingly, snout tip (132) may be made from the same refractory material or from different refractory material. Still other suitable refractory materials will be apparent to one with ordinary skill in the art in view of the teachings herein.

Snout tip (132) can be made by casting the refractory material. In some other versions, components may be made by pouring the liquid refractory material into a mold and using heat to bake the refractory material to remove moisture. An outer surface of the component may then be ground to provide a smooth outer surface. Still other suitable methods to make snout tip (132) will be apparent to one with ordinary skill in the art in view of the teachings herein.

The refractory material of snout tip (132) may provide resistance to wear, thermal shock, and/or corrosion of snout tip (132). Snout tip (132) can also be reusable in coating portion (10) of a steel processing line (2). Snout tip (132) may thereby increase the life of coating portion (10) to increase efficiency and/or reduce costs of the coating line. Accordingly, by forming snout tip (132) from a refractory material, snout tip (132) may better withstand and resist mechanical erosion and cavitation than a steel surface.

In some instances, it can be challenging to join a refractory material of snout tip (132) with a metallic material of snout (30) due to the differences in physical and mechanical properties. Accordingly, in some versions, the refractory material of snout tip (132) can include about 25% by weight addition of metal filaments for additional strength and impact resistance. Such metal filaments can include austenitic stainless steel wire or other suitable metal pieces that can help in attaching snout tip (132) with snout (30), such as by welding.

Figure 6:
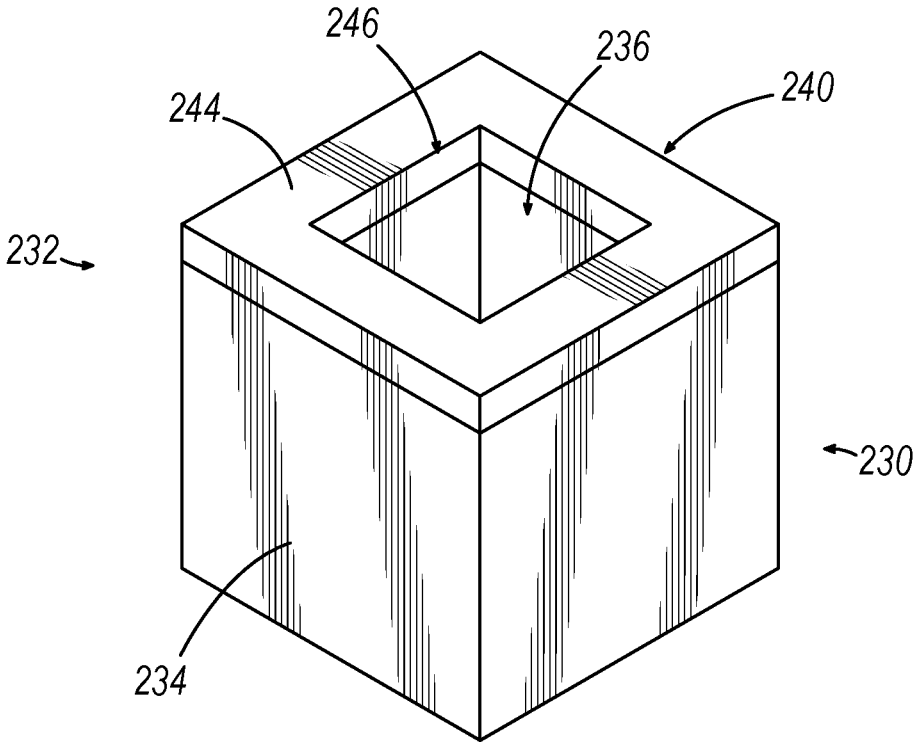
FIG. 6 depicts a perspective view of a second exemplary snout tip having a refractory material for use with a snout in a coating portion such as in the continuous steel processing line of FIG. 1.
Figure 7:
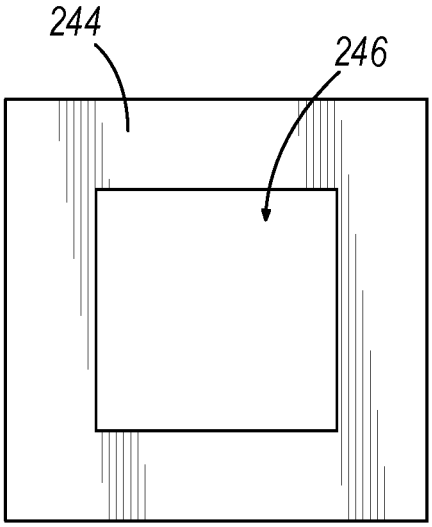
FIG. 7 depicts a top plan view of the snout tip of FIG. 6.
Figure 8:
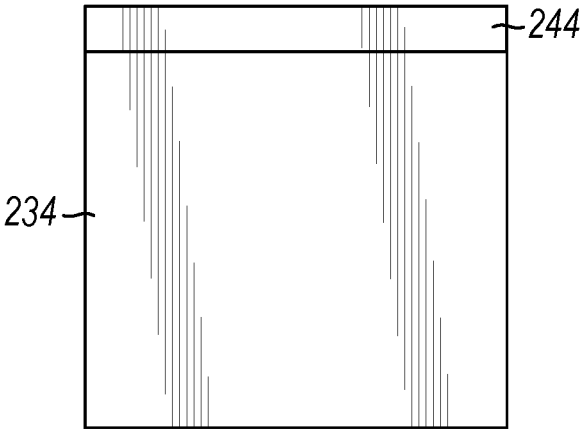
FIG. 8 depicts a front view of the snout tip of FIG. 6.
Figure 9:
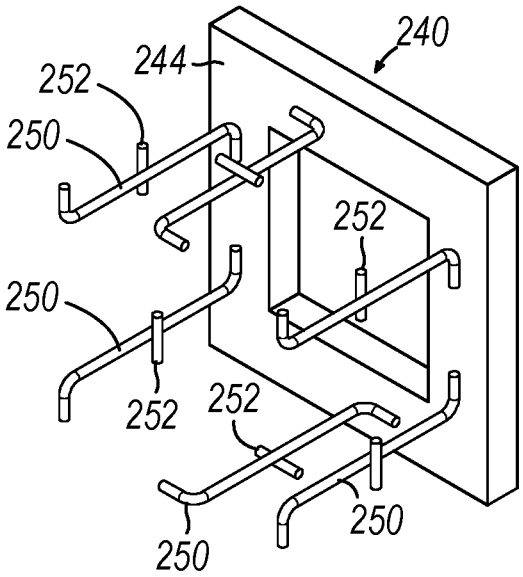
FIG. 9 depicts a perspective view of a plate of the snout tip of FIG. 6.
Figure 10:
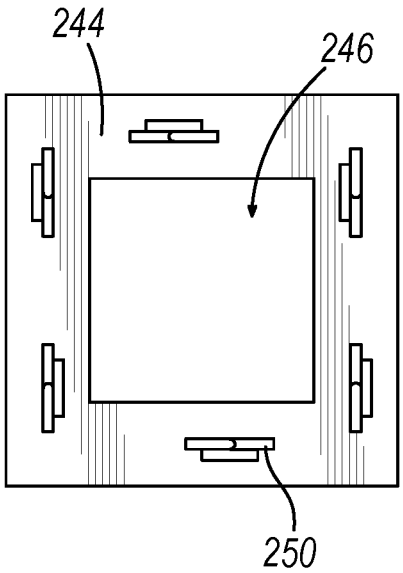
FIG. 10 depicts a bottom view of the plate of FIG. 9.
Figure 11:
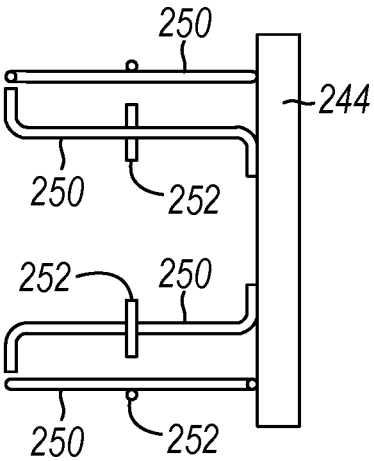
FIG. 11 depicts a side elevational view of the plate of FIG. 9.
Figure 12:
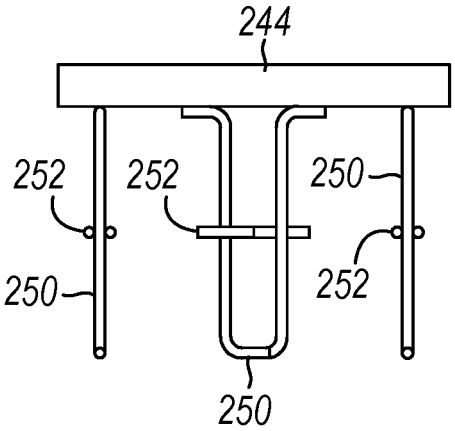
FIG. 12 depicts a front view of the plate of FIG. 9.
Figure 13:
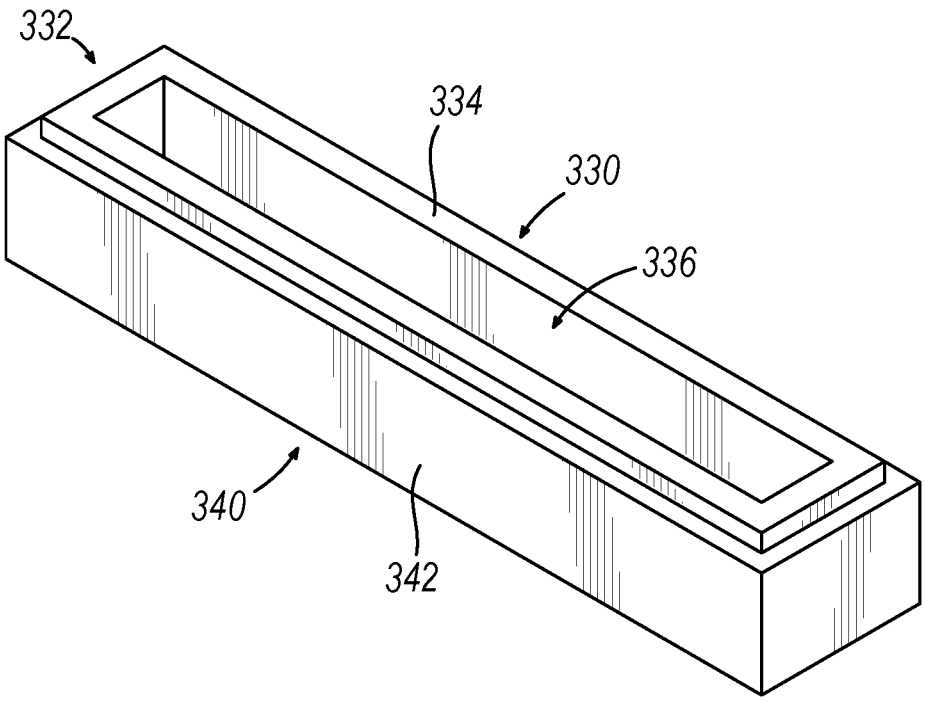
FIG. 13 depicts a perspective view of a third exemplary snout tip having a refractory material for use with a snout in a coating portion such as in the continuous steel processing line of FIG. 1.
Figure 14:
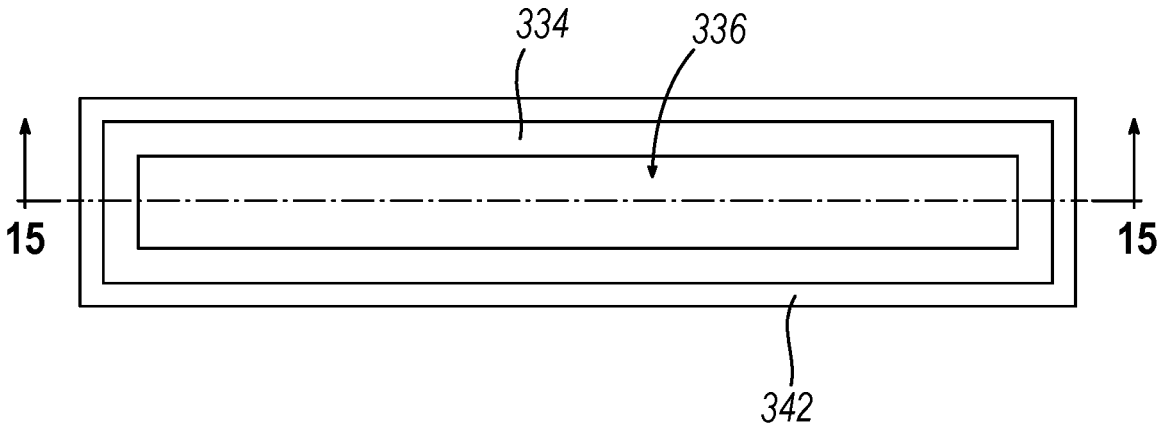
FIG. 14 depicts a top plan view of the snout tip of FIG. 13.
Figure 15:
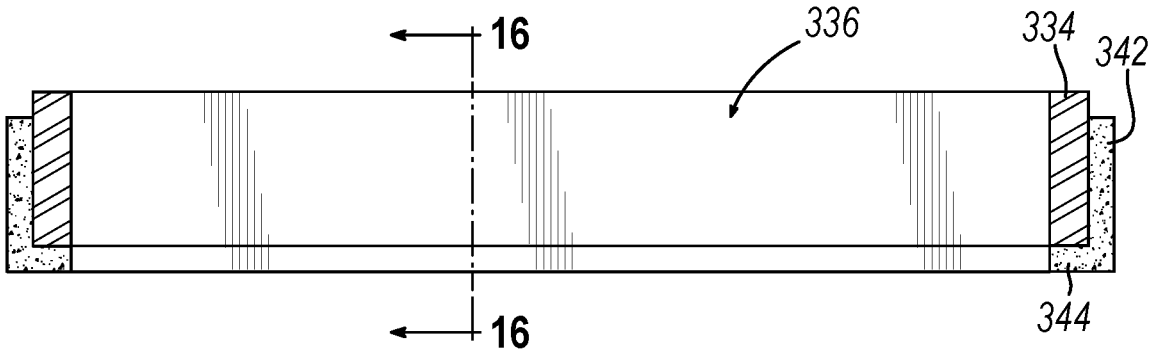
FIG. 15 depicts a cross-sectional view of the snout tip of FIG. 13 taken along line 15-15 of FIG. 14.
Figure 16:
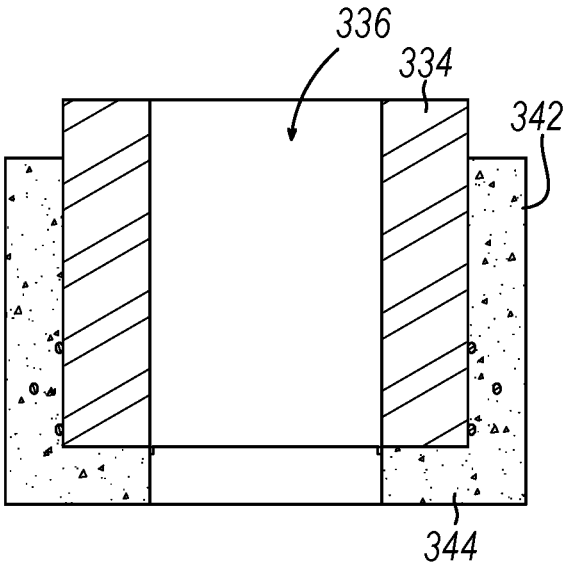
FIG. 16 depicts another cross-sectional view of the snout tip of FIG. 13 taken along line 16-16 of FIG. 15.

FIGS. 6-8 show another exemplary snout tip (232) that can be coupled with a snout (30) of a coating portion (10) in a continuous steel processing line for receiving steel strip (60). Snout tip (232) comprises a bottom portion (230) coupled with a plate (240). Bottom portion (230) comprises a body (234) that defines an opening (236) therethrough for receiving steel strip (60). While body (234) and opening (236) are shown as being substantially square in the illustrated version, body (234) and/or opening (236) can be any suitable shape (e.g., rectangular, elliptical, round, etc.) that is configured to receive steel strip (60). At least a portion of bottom portion (230) is configured to be immersed in molten metal (22) of hot dip tank (20) to thereby protect steel sheet (60) from atmosphere. Bottom portion (230) can have a thickness of about 12.5 inches and a diameter of about 14 inches to define an opening (236) of about 8 inches by about 8 inches, though other suitable dimensions can be used for providing a portion of snout tip (232) to be submersed in molten metal (22). Bottom portion (230) comprises a refractory material, as described above, that has high strength and is resistant to wear at high temperature.

Bottom portion (230) can be made by casting the refractory material. In some other versions, components may be made by pouring the liquid refractory material into a mold and using heat to bake the refractory material to remove moisture. An outer surface of the component may then be ground to provide a smooth outer surface. Still other suitable methods to make bottom portion (230) will be apparent to one with ordinary skill in the art in view of the teachings herein.

Bottom portion (230) is coupled with plate (240) to improve the connection, such as a weld, between snout tip (232) and snout (30) of coating portion (10) in a continuous steel processing line. Plate (240) is shown in more detail in FIGS. 9-12. Plate (240) of the illustrated version comprises a body (244) that defines an opening (246) therethrough that corresponds to opening (236) of bottom portion (230) for receiving steel strip (60). While body (244) and opening (246) are shown as being substantially square in the illustrated version, body (244) and/or opening (246) can be any suitable shape (e.g., rectangular, elliptical, round, etc.) that is configured to receive steel strip (60). Because it can be difficult to weld a refractory material in some instances, plate (240) can be made of steel, stainless steel, and/or other suitable weldable material that can be welded with a snout (30) to improve a coupling of snout tip (232) with snout (30). Plate (240) can have a thickness of about 1.5 inches and a diameter corresponding to bottom portion (230) of about 14 inches to define an opening (246) of about 8 inches by about 8 inches, though other suitable dimensions can be used to provide a weldable portion for snout tip (232).

In the illustrated version shown in FIGS. 9-12, plate (240) further comprises one or more supports (250) having a first end portion coupled with a bottom surface of body (244) of plate (240) and a second end portion extending downwardly from plate (240) to within body (234) of bottom portion (230). Supports (250) are configured to support and/or maintain the position of bottom portion (230) relative to plate (240). In the illustrated version, each support (250) includes an s-shaped configuration having a crossbar (252) extending transversely relative to support (250) at a central portion of support (250). Such a configuration for supports (250) can be used to couple bottom portion (230) with plate (240), though any other suitable configuration can be used for coupling bottom portion (230) with plate (240). Support (250) can have a length of about 9 inches and a diameter of about ⅜ inches, though any other suitable dimensions can be used for providing support of bottom portion (230). In the illustrated version, plate (240) comprises six supports (250). For instance, a first pair of supports (250) is positioned on a first side portion of plate (240) and a second pair of supports (250) is positioned on an opposing second side portion of plate (240) such that each pair of supports (250) are longitudinally aligned relative to each other. A fifth support (250) is positioned on a third side portion of plate (240) and a sixth support (250) is positioned on an opposing fourth side portion of plate (240) such that these supports (250) are longitudinally offset relative to each other. Still other suitable configurations and/or number of supports (250) can be used for providing support of bottom portion (230). Each support (250) can be made of steel or any other suitable material for supporting bottom portion (230) on plate (240). Accordingly, a refractory material of bottom portion (230) can be cast about supports (250) to form snout tip (232).

The refractory material of bottom portion (230) of snout tip (232) may thereby provide resistance to wear, thermal shock, and/or corrosion of snout tip (232). Snout tip (232) may thereby increase the life of coating portion (10) to increase efficiency and/or reduce costs of the coating line. Accordingly, by forming bottom portion (230) of snout tip (232) from a refractory material, snout tip (232) may better withstand and resist mechanical erosion and cavitation than a steel surface.

FIGS. 13-16 show another exemplary snout tip (332) that can be coupled with a snout (30) of a coating portion (10) in a continuous steel processing line for receiving steel strip (60). Snout tip (332) comprises a core (330) and an outer layer (340). Core (330) comprises a body (334) that defines an opening (336) therethrough for receiving steel strip (60). While body (334) and opening (336) are shown as being substantially rectangular in the illustrated version, body (334) and/or opening (336) can be any suitable shape (e.g., square, elliptical, round, etc.) that is configured to receive steel strip (60). Core (330) can be made from steel and/or any other suitable material. Core (330) can have a width of about 14 inches, a length of about 82 inches, a height of about 12 inches, and a thickness of about 3 inches to form an opening (336) of about 8 inches by about 76 inches, though any other suitable dimensions can be used for receiving steel strip (60).

Outer layer (340) is positioned about at least a portion of an outer surface of body (334) of core (330). For instance, outer layer (340) comprises a side portion (342) extending along an outer surface of a side portion of body (334) and a bottom portion (344) extending along an outer surface of a bottom portion of body (334). Outer layer (340) comprises a refractory material, as described above, that has high strength and is resistant to wear at high temperature. Accordingly, when at least a portion of snout tip (332) is configured to be immersed in molten metal (22) of hot dip tank (20) to protect steel sheet (60) from atmosphere, outer layer (340) is configured to protect core (330) from molten metal (22). Outer layer (340) can have a thickness of about 2 inches, though any other suitable dimensions can be used for sufficient protection of core (330) from molten metal (22).

Outer layer (340) can be made by casting the refractory material about core (330). In some other versions, components may be made by pouring a liquid refractory material into a mold and using heat to bake the refractory material to remove moisture. In some versions, body (334) of core (330) can include one or more recesses extending inwardly within body (334) from an outer surface of body (334) adjacent to outer layer (340) that are configured to receive the refractory material within the one or more recesses to aid in the attachment of outer layer (340) with core (330). An outer surface of the component may then be ground to provide a smooth outer surface. Still other suitable methods to make outer layer (340) will be apparent to one with ordinary skill in the art in view of the teachings herein.

Accordingly, the refractory material of outer layer (340) of snout tip (332) may provide resistance to wear, thermal shock, and/or corrosion of snout tip (332). Snout tip (332) may thereby increase the life of coating portion (10) to increase efficiency and/or reduce costs of the coating line. Accordingly, by forming outer layer (340) of snout tip (332) from a refractory material, snout tip (332) may better withstand and resist mechanical erosion and cavitation than a steel surface.

II. Examples

A test was performed to evaluate a snout assembly comprising a refractory material, which is detailed below in the following Examples. It should be understood that the following examples are merely for illustrative purposes and that in other instances, various alternative characteristics may be used as will be understood by those of ordinary skill in the art in view of the teachings herein.

Example 1

A snout assembly having a snout tip similar to snout tip (132) described above was prepared to perform an in situ trial. The snout assembly included a snout tip comprising a ceramic material. In the trial, the snout tip was made from SIFCA Al having 25% stainless steel wire filaments mixed with the ceramic material. The density of the snout tip was about 0.107 pounds per cubic inch. The snout tip was immersed in molten aluminum for 34 days. The snout tip was heated at a rate of about 100° F. per hour to about 1300° F. The Linear Coefficient of Thermal Expansion (LTCE) was calculated to be about $10.1\times10^{-6}$ in/in/° F. The snout tip was then visually inspected, and it was determined that there was not a substantial change in the weight or dimensions of the snout tip. Through the visual inspection, there were cracks in a few areas of localized degradation. The trial was considered to be successful.

Example 2

A snout tip for use in a snout assembly of a continuous coating line, wherein the snout tip comprises a body defining an opening therethrough for receiving a steel strip, wherein at least a portion of the body is configured to be immersed in molten metal to provide a seal around the steel strip during entry into the molten metal, wherein the snout tip comprises a refractory material to provide corrosion resistance in response to the molten metal.

Example 3

The snout tip of example 2, wherein the refractory material comprises a select one or more of alumina, silicon dioxide, silicon carbide, and fused silica.

Example 4

The snout tip of any one or more of examples 2 through 3, wherein the body is made from the refractory material, wherein the refractory material comprises metal filaments within the refractory material.

Example 5

The snout tip of example 4, wherein the metal filaments include stainless steel wire.

Example 6

The snout tip of any one or more of examples 2 through 5, wherein the snout tip comprises a plate and a bottom portion extending downwardly from the plate such that at least a portion of the bottom portion is configured to be immersed in the molten metal, wherein the plate is weldable with a snout of the snout assembly, wherein the bottom portion is made from the refractory material.

Example 7

The snout tip of example 6, wherein the plate comprises one or more supports extending from the plate to within the bottom portion to provide support of the bottom portion relative to the plate.

Example 8

The snout tip of example 7, wherein the plate comprises a first pair of supports positioned on a first side portion of the plate and a second pair of supports positioned on an opposing second side portion of the plate such that the first and second pair of supports are longitudinally aligned relative to each other.

Example 9

The snout tip of any one or more of examples 7 through 8, wherein the plate comprises a first support positioned on a side portion of the plate and a second support positioned on an opposing side portion of the plate such that the first and second supports are longitudinally offset relative to each other.

Example 10

The snout tip of any one or more of examples 2 through 9, wherein the snout tip comprises a core and an outer layer positioned about at least a portion of an outer surface of the core, wherein the outer layer is made from the refractory material.

Example 11

The snout tip of example 10, wherein the outer layer comprises a side portion extending along an outer surface of a side portion of the core and a bottom portion extending along an outer surface of a bottom portion of the core.

Example 12

A coating portion of a continuous coating line configured to receive an elongated steel sheet for coating the steel sheet comprising: a hot dip tank for receiving molten metal; one or more roll assemblies for supporting the steel sheet through the coating portion; and a snout assembly positioned about the steel sheet at an entry of the hot dip tank, wherein the snout assembly comprises a snout tip configured to be submerged in the molten metal to seal the steel sheet during entry into the molten metal, wherein the snout tip comprises a refractory material to provide corrosion resistance in response to the molten metal.

Example 13

The coating portion of example 12, wherein the refractory material comprises a select one or more of alumina, silicon dioxide, silicon carbide, and fused silica.

Example 14

The coating portion of any one or more of examples 12 through 13, wherein the refractory material comprising stainless steel wire such that the snout tip is weldable with the snout assembly.

Example 15

The coating portion of any one or more of examples 12 through 14, wherein the snout tip comprises a plate that is weldable with the snout assembly and a bottom portion extending from the plate such that at least a portion of the bottom portion is configured to be immersed in the molten metal, wherein the bottom portion is made from the refractory material.

Example 16

The coating portion of example 15, wherein the plate comprises one or more supports extending from the plate to within the bottom portion to provide support of the bottom portion relative to the plate.

Example 17

The coating portion of example 16, wherein the plate comprises a first pair of supports positioned on a first side portion of the plate and a second pair of supports positioned on an opposing second side portion of the plate such that the first and second pair of supports are longitudinally aligned relative to each other.

Example 18

The coating portion of any one or more of examples 16 through 17, wherein the plate comprises a first support positioned on a side portion of the plate and a second support positioned on an opposing side portion of the plate such that the first and second supports are longitudinally offset relative to each other.

Example 19

The coating portion of any one or more of examples 12 through 18, wherein the snout tip comprises a core and an outer layer positioned about a portion of an outer surface of the core, wherein the outer layer comprises the refractory material.

Example 20

The coating portion of example 19, wherein the outer layer comprises a side portion extending along an outer surface of a side portion of the core and a bottom portion extending along an outer surface of a bottom portion of the core.

Example 21

A snout for use in a coating portion of a continuous coating line, wherein the snout comprises a body defining an opening there through for receiving a steel strip, wherein at least a portion of the body is configured to be immersed in molten metal to provide a seal around the steel strip during entry into the molten metal, wherein at least the portion of the snout to be immersed in the molten metal comprises a refractory material to provide corrosion resistance in response to the molten metal.

What is claimed is:

1. A snout tip for use in a snout assembly of a continuous coating line, wherein the snout tip comprises a body defining an opening therethrough for receiving a steel strip, wherein at least a portion of the body is configured to be immersed in molten metal to provide a seal around the steel strip during entry into the molten metal, wherein the snout tip comprises a core and an outer layer positioned about at least a portion of an outer surface of the core, wherein the outer layer is made from a refractory material.

2. The snout tip of claim 1, wherein the refractory material comprises a select one or more of alumina, silicon dioxide, silicon carbide, and fused silica.

3. The snout tip of claim 1, wherein the refractory material comprises metal filaments within the refractory material.

4. The snout tip of claim 3, wherein the metal filaments include stainless steel wire.

5. The snout tip of claim 1, wherein the outer layer comprises a side portion extending along an outer surface of a side portion of the core and a bottom portion extending along an outer surface of a bottom portion of the core.

6. A snout tip for use in a snout assembly of a continuous coating line, wherein the snout tip comprises a body defining an opening therethrough for receiving a steel strip, wherein at least a portion of the body is configured to be immersed in molten metal to provide a seal around the steel strip during entry into the molten metal, wherein the snout tip comprises a refractory material, wherein the snout tip comprises a plate and a bottom portion extending downwardly from the plate such that at least a portion of the bottom portion is configured to be immersed in the molten metal, wherein the plate is weldable with a snout of the snout assembly, wherein the bottom portion is made from the refractory material, wherein the plate comprises one or more supports extending from the plate to within the bottom portion to provide support of the bottom portion relative to the plate.

7. The snout tip of claim 6, wherein the plate comprises a first pair of supports positioned on a first side portion of the plate and a second pair of supports positioned on an opposing second side portion of the plate such that the first and second pair of supports are longitudinally aligned relative to each other.

8. The snout tip of claim 6, wherein the plate comprises a first support positioned on a side portion of the plate and a second support positioned on an opposing side portion of the plate such that the first and second supports are longitudinally offset relative to each other.

9. A coating portion of a continuous coating line configured to receive an elongated steel sheet for coating the steel sheet comprising:

a hot dip tank for receiving molten metal;

one or more roll assemblies for supporting the steel sheet through the coating portion; and a snout assembly positioned about the steel sheet at an entry of the hot dip tank, wherein the snout assembly comprises a snout tip configured to be submerged in the molten metal to seal the steel sheet during entry into the molten metal, wherein the snout tip comprises a plate that is weldable with the snout assembly and a bottom portion extending from the plate such that at least a portion of the bottom portion is configured to be immersed in the molten metal, wherein the bottom portion is made from a refractory material, wherein the plate comprises one or more supports extending from the plate to within the bottom portion to provide support of the bottom portion relative to the plate.

10. The coating portion of claim 9, wherein the refractory material comprises a select one or more of alumina, silicon dioxide, silicon carbide, and fused silica.

11. The coating portion of claim 9, wherein the refractory material comprises metal filaments within the refractory material.

12. The coating portion of claim 9, wherein the plate comprises a first pair of supports positioned on a first side portion of the plate and a second pair of supports positioned on an opposing second side portion of the plate such that the first and second pair of supports are longitudinally aligned relative to each other.

13. The coating portion of claim 9, wherein the plate comprises a first support positioned on a side portion of the plate and a second support positioned on an opposing side portion of the plate such that the first and second supports are longitudinally offset relative to each other.

14. A coating portion of a continuous coating line configured to receive an elongated steel sheet for coating the steel sheet comprising:

a hot dip tank for receiving molten metal;

one or more roll assemblies for supporting the steel sheet through the coating portion; and a snout assembly positioned about the steel sheet at an entry of the hot dip tank, wherein the snout assembly comprises a snout tip configured to be submerged in the molten metal to seal the steel sheet during entry into the molten metal, wherein the snout tip comprises a core and an outer layer positioned about a portion of an outer surface of the core, wherein the outer layer comprises arefractory material.

15. The coating portion of claim 14, wherein the outer layer comprises a side portion extending along an outer surface of a side portion of the core and a bottom portion extending along an outer surface of a bottom portion of the core.

* * * * *